US005972068A

United States Patent [19]

Seki et al.

[11] Patent Number: 5,972,068

[45] Date of Patent: Oct. 26, 1999

[54] CONTACT MATERIAL FOR VACUUM VALVE

[75] Inventors: Tsuneyo Seki; Atsushi Yamamoto; Takashi Kusano, all of Tokyo; Tsutomu Okutomi, Kanagawa-ken, all of Japan

[73] Assignee: Kabushiki Kaisha Toshiba, Kawasaki, Japan

[21] Appl. No.: 09/035,998

[22] Filed: Mar. 6, 1998

[30] Foreign Application Priority Data

Mar. 7, 1997 [JP] Japan ..... 9-052763

[51] Int. Cl.[6] ..... C22C 1/04

[52] U.S. Cl. ..... 75/245; 75/248; 200/265; 200/266; 419/38

[58] Field of Search ..... 75/245, 248; 252/514, 252/515; 419/38; 200/265, 266

[56] References Cited

U.S. PATENT DOCUMENTS

| | | | |
|---|---|---|---|
| 4,626,282 | 12/1986 | Naya et al. | 75/247 |
| 4,853,184 | 8/1989 | Naya et al. | 420/489 |
| 4,870,231 | 9/1989 | Naya et al. | 200/262 |
| 4,917,722 | 4/1990 | Kuniya et al. | 75/232 |
| 4,927,989 | 5/1990 | Naya et al. | 200/265 |
| 4,954,170 | 9/1990 | Fey et al. | 75/229 |
| 5,019,156 | 5/1991 | Naya et al. | 75/245 |
| 5,246,512 | 9/1993 | Seki et al. . | |
| 5,354,352 | 10/1994 | Seki et al. . | |
| 5,403,543 | 4/1995 | Okutomi et al. . | |

FOREIGN PATENT DOCUMENTS

| | | |
|---|---|---|
| 54-71375 | 6/1979 | Japan . |
| 61-41091 | 9/1986 | Japan . |
| 1-33011 | 7/1989 | Japan . |
| 3-047931 | 2/1991 | Japan . |

*Primary Examiner*—Ngoclan Mai

*Attorney, Agent, or Firm*—Oblon, Spivak, McClelland, Maier & Neustadt, P.C.

[57] ABSTRACT

The vacuum valve contact material of the present invention is manufactured by a step of mixing an anti-arc constituent powder and a conductive constituent powder, a step of forming, and a step of sintering the formed body below the melting point of the conductive constituent, and has improved arc interruption performance.

18 Claims, 1 Drawing Sheet

CONTACT MATERIAL FOR VACUUM VALVE

BACKGROUND OF THE INVENTION

1. Field of the Invention

The present invention relates to a contact material for a vacuum valve whereby a stable voltage withstanding characteristic is obtained.

2. Description of the Related Art

Conventionally, the three basic characteristics required by a contact material are anti-welding interrupting characteristics, voltage withstanding characteristics and current interrupter characteristics; additionally, low and stable temperature rise characteristics and contact resistance characteristics are important requirements.

However, since some of these requirements are contradictory, it is not possible to satisfy all the requirements by metal of a single type. For this reason, in many of the contact materials that are practically employed, two or more elements are used in combination in order to mutually compensate for each others' deficiencies and contact materials for special applications such as large current or high voltage are being developed; some of these have excellent characteristics in their own way. However, the present situation is that no vacuum valve contact material has yet been obtained that fully satisfies increasingly severe requirements in terms of high voltage withstanding characteristic and large current interrupter characteristic.

In recent years, for example Cu (copper) or Cr (chromium) contacts, which have excellent voltage withstanding characteristics, have come to be chiefly used in ordinary circuit breakers in order to satisfy such demands. Methods of manufacturing CuCr contacts include the solid-phase sintering method comprising mixing Cu powder and Cr powder, forming and sintering, the infiltration method, in which manufacture is effected by infiltrating Cu into a Cr skeleton, and the arc welding method etc. Of these various methods of manufacture, the solid-phase sintering method is the most convenient method of manufacture, and has the characteristic advantage of enabling manufacture at low cost but, on the other hand, it was subject to the problem that the voltage withstanding characteristic was inferior.

As described above, the prior art is subject to the problem that contacts manufactured by the solid-phase sintering method, which is an inexpensive method of manufacture, are inferior in voltage withstanding characteristic.

SUMMARY OF THE INVENTION

Accordingly, one object of the present invention is to provide a vacuum valve contact material wherein, in particular, the voltage withstanding characteristic is improved, yet which is obtained by a solid-phase sintering method.

The above object of the present invention is achieved by providing a contact material for a vacuum valve having the following constitution. Specifically, a single-crystal anti-arc constituent is included in contact material for a vacuum valve manufactured by a process including: a step of mixing an anti-arc constituent powder and a conducting constituent powder, a forming step, and a step of sintering the formed body below the melting point of the conducting constituent.

Further, the above object of the present invention is achieved by providing a vacuum valve contact material having the following constitution. Specifically, the single-crystal anti-arc component powder is to be not less than 50 volume %.

Further, the above object of the present invention is achieved by the provision of a vacuum valve contact material having the following constitution. Specifically, the anti-arc constituent includes at least one or more of Cr, W (tungsten), Mo (molybdenum) and Ti (titanium), and the conductive constituent includes at least one or more of Cu and Ag (silver).

The above object of the present invention is further achieved by providing a vacuum valve contact material having the following constitution. Specifically, the anti-arc constituent content is 20~60 volume %.

Further, the above object of the present invention is achieved by the provision of a vacuum valve contact material having the following constitution. Specifically, the mean particle size of the anti-arc component is not more than 150 $\mu$m (micron).

Further, the above object of the present invention is achieved by the provision of a vacuum valve contact material having the following constitution. Specifically, it contains Cr powder having up to 1 weight % of at least one or more of Al (aluminium), Si (silicon), Ti, V (vanadium), Zr (zirconium), Mo (molybdenum), W and Fe (iron).

Further, the above object of the present invention is achieved by the provision of a vacuum valve contact material having the following constitution. Specifically, it contains W powder containing up to 1 weight % of at least one or more of Mo, Re (rhenium), Ta (tantalum) and Nb (niobium).

Further, the above object of the present invention is achieved by provision of a vacuum valve contact material having the following constitution. Specifically, it contains Mo (molybdenum) powder containing up to 1 weight % of at least one or more of W, Re, Ta and Nb.

Further, the above object of the present invention is achieved by the provision of a vacuum valve contact material having the following constitution. Specifically, it contains up to 1 volume % of at least one or more of Bi (bismuth), Te and Sb.

One cause of deterioration of the anti-arc characteristic is loss of particles from the surface of the contact. As a method of ameliorating this, in order to improve adhesion between the anti-arc constituent and conductive constituent, the method may be adopted for example of adding a minute content of a third element to the conductive constituent; such a method is particularly effective in regard to the infiltration method, which is a method in which the conductive constituent is melted.

However, it could not be expected that such techniques would be of much benefit in regard to the low-cost manufacturing method represented by the solid-phase sintering method. Searching for the causes of this, it was found that the cause lay in the micro-structure of the anti-arc constituent. In other words, it is essential to eliminate the forming step [that is used to achieve] high density in manufacture of contacts by the solid-phase sintering method.

Even if, in order to achieve high density, the forming step and sintering step are repeated a plurality of times, a considerable forming pressure is still necessary; in order to obtain the prescribed density with a single forming step, a forming pressure of for example 7 Ton/cm$^2$ is necessary.

When such high density is applied, the pressure to which the anti-arc constituent is subjected is considerable, so, in the case where the anti-arc constituent particles are polycrystalline particles, destruction of the particles occurs from the particle boundaries where strength is lower. However, since the sintering temperature in the subsequent sintering step is below the melting point of the conductive constituent, re-bonding of the portions where the anti-arc constituent particles have been destroyed cannot be achieved.

As a means of solving this problem, we have discovered that in particular a careful selection of the anti-arc constituent material, in particular, the use of a single-crystal material, is beneficial. Specifically, single-crystal particles are much less likely to experience cracking when subjected to high forming pressures, with the result that loss of particles from the contact surface due to roughening of the contact surface produced by opening and closure is diminished, giving good results in terms of the anti-arc characteristic.

However, there is a close relationship between forming pressure and particle diameter of the powder not only in the case of polycrystalline particles but also when single crystals are employed. Firstly, as regards particle size of the powder, it is found that even for the same forming pressure, if the particle size is large, destruction of the particles tends to be facilitated.

Also, as regards the forming pressure, the destruction of particles is of course more severe when the forming pressure is larger and, furthermore, the damage tends to be more severe in the case of polycrystalline particles than with single-crystal particles. Also, although, in order to obtain high density with a smaller number of forming steps, it is advantageous to employ high forming pressure, as described above, this facilitates the progress of particle destruction.

As a method of improving this situation, it was found that higher forming pressure could be applied by making the anti-arc constituent powder stronger by addition of a trace element to the anti-arc raw material powder.

It was further discovered that the voltage withstanding characteristic could also be maintained if the anti-arc constituent powder does not employ single crystals exclusively, but rather employs them with admixture of some content of polycrystalline powder.

It was also discovered that the addition of a certain amount of welding prevention constituent was beneficial from the point of view of reducing the separation force of the switch. Thanks to these new discoveries, it was found that the voltage withstanding performance could be improved even in the low-cost solid-phase sintering method.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
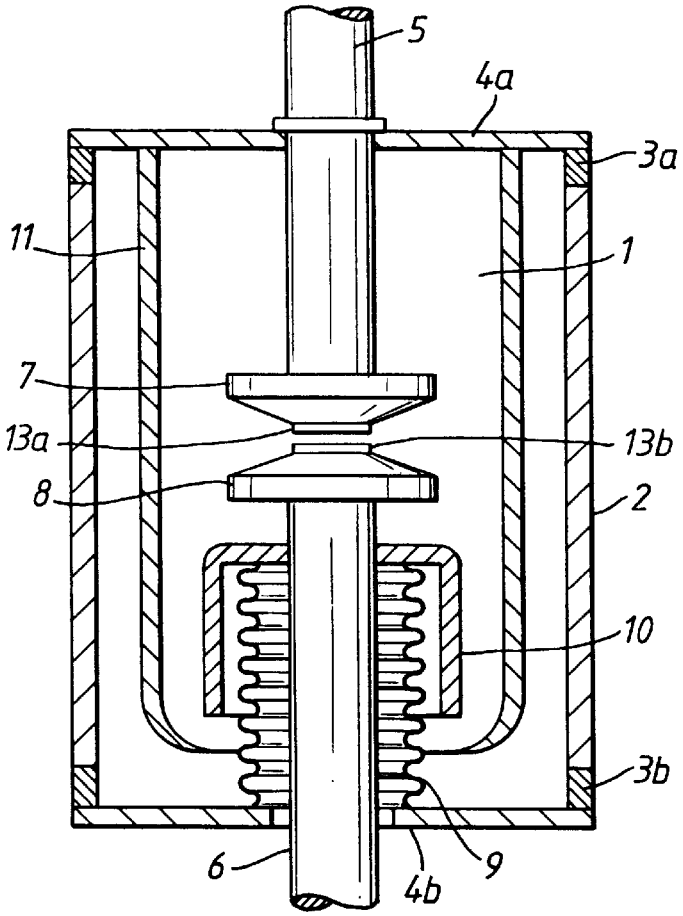
FIG. 1 is a cross-sectional view of a vacuum valve illustrating an embodiment of the present invention.

Referring now to the drawings, wherein like reference numerals designate identical or corresponding parts throughout the several views, and more particularly to FIG. 1 thereof, one embodiment of the present invention will be described.

Next, an embodiment of a vacuum valve contact material according to the present invention will be described. FIG. 1 and FIG. 2 are diagrams showing the layout of a vacuum valve in which contact material according to the present invention has been employed. A current interrupter chamber 1 is constructed in airtight manner by means of an insulating vessel 2 formed in practically cylindrical shape by means of insulating material and metal covers 4*a*, 4*b* provided at both ends thereof with sealing metal 3*a*, 3*b* therebetween.

Within current interrupter chamber 1, a pair of electrodes 7, 8 mounted at facing ends of conducting rods 5, 6 are arranged, upper electrode 7 being a fixed electrode while lower electrode 8 is a movable electrode. Also, movement of electrode 8 in the axial direction whilst maintaining vacuum-tightness of interrupter chamber 1 is achieved by mounting of a bellows 9 on electrode rod 6 connected to electrode 8, and bellows 9 is prevented from being covered by arc vapour by the provision of a metallic arc shield 10 above bellows 9.

11 is a metallic arc shield provided in interrupter chamber 1 to prevent insulating vessel 2 being covered by arc vapour, by covering electrodes 7 and 8. Furthermore, electrode 8 is fixed by means of brazing 12 or is pressure-fixed by caulking to conducting rod 6 as shown to a larger scale in FIG. 2.

Figure 2:
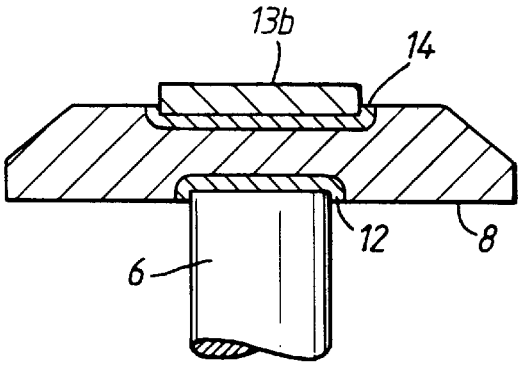
FIG. 2 is a cross-sectional view showing the contacting region of FIG. 1 to a larger scale.

Contact 13*a* is fixed by brazing 14 to electrode 8. 13*b* in FIG. 1 is the moving contact. The contact material according to this embodiment is suitable for constituting one or both of contacts 13*a*, 13*b* mentioned above. Next, a method of evaluating contacts will be described.

(1) Voltage Withstanding Characteristic

Contacts manufactured by the solid-phase sintering method were evaluated by processing through a prescribed contact shape of ϕ45 mm (diameter)×5 mm (thickness), followed by assembly into a prescribed vacuum valve and evaluation of the probability of restriking by an advance small current test. The current was 500 A and the recovery voltage was 12.5 kV. The number of times of testing was 2000 times.

EXAMPLES 1, 2 and COMPARATIVE EXAMPLE 1

Single-crystal Cr powder and polycrystalline Cr powder of mean particle size 100 μm and Cu powder of mean particle size less than 44 μm were prepared. Specifically, in Example 1, the respective ratios of (A) single-crystal Cr powder, (B) polycrystalline Cr powder and (C) Cu powder by volume were 30%, 0% and 70%; in Example 2, these ratios were (A): (B): (C)=15%: 15%: 70%, and in Comparative Example 1, these ratios were (A): (B): (C)=0%: 30%: 70%.

These powders were respectively mixed and formed at a forming pressure of 8 Ton/cm$^2$.

Next, contacts were obtained by sintering under the conditions 1050° C. (degrees Centigrade)×2 Hr (hour) under a vacuum atmosphere of about $10^{-3}$ Pa (Pascal). These were processed to the prescribed shape and assembled in a vacuum valve and the restriking characteristic evaluated.

TABLE 1

| | Blending ratio (volume %) | | | Cr single | Occurrence of | |
|---|---|---|---|---|---|---|
| | Single-crystal Cr | Poly-crystalline Cr | Cu | crystal Content (%) | restriking Probability (%) | Notes |
| Example 1 | 30 | 0 | 70 | 100 | 0.20 | |
| Example 2 | 15 | 15 | 70 | 50 | 0.30 | |
| Comparative Example 1 | 0 | 30 | 70 | 0 | 0.50 | |

From these results, it can be seen that when all the Cr particles are polycrystalline particles, there is no improvement in the restriking characteristic; it can be seen that it is necessary that at least 50% of the total Cr should be single-crystal Cr.

COMPARATIVE EXAMPLE 2, EXAMPLES, 3, 4

Next, the correlation with raw material Cr particle size was studied.

Using single-crystal Cr powder of mean particle size respectively 500 μm, 150 μm and 50 μm, contacts were manufactured of the same composition and by the same steps as in Example 1, and the restriking characteristic was evaluated (respectively, Comparative Example 2 and Examples 3, 4).

TABLE 2

| | Blending ratio (volume %) | | Cr particle | Restriking occurrences | |
|---|---|---|---|---|---|
| | single crystal Cr | Cu | size (μm) | Probability (%) | Notes |
| Comparative Example 2 | 30 | 70 | 500 | 0.40 | |
| Example 3 | 30 | 70 | 150 | 0.25 | |
| Example 4 | 30 | 70 | 50 | 0.15 | |

If the Cr particles are large as in Comparative Example 2, the probability of occurrence of restriking is high, probably because of occurrence of cracking of the Cr particles in the forming step. From the results of the present test, the maximum particle size of the Cr was found to be 150 μm.

COMPARATIVE EXAMPLE 3, EXAMPLES 5, 6 and 7, and COMPARATIVE EXAMPLE 4

Next, the Cr content was studied.

Contacts were manufactured by the same process as in Example 1 but in which the volume % of Cr was respectively 5, 20, 40, 60 and 80%, using single-crystal Cr raw material of mean particle size 100 μm just as in Example 1, and these contacts were evaluated (respectively, Comparative Example 3, Examples 5, 6 and 7 and Comparative Example 4).

TABLE 3

| | Blending ratio (volume %) | | Cr particle | Occurrences of restriking | |
|---|---|---|---|---|---|
| | Single-crystal Cr | Cu | size (μm) | Probability (%) | Notes |
| Comparative Example 3 | 5 | 95 | 100 | 0.20 | Interruption performance impaired |
| Example 5 | 20 | 80 | 100 | 0.20 | |
| Example 6 | 40 | 60 | 100 | 0.20 | |
| Example 7 | 60 | 40 | 100 | 0.25 | |
| Comparative Example 4 | 80 | 20 | 100 | 0.50 | |

As can be seen from these results, if the Cr content is small, the probability of restriking is low and excellent performance is obtained; however, when the Cr content reaches 80 volume %, the probability of adhesion between adjacent Cr particles becomes large, so phenomena resembling cracking of the Cr particles as described above occur, tending to cause the frequency of restriking to become large. Also, although good restriking performance is obtained with low Cr, if the Cr content is extremely small, present investigations indicate that interruption performance is impaired.

EXAMPLES 8 and 9

Next, the effect of addition of trace elements to the Cr powder was studied. Contacts were manufactured by the same steps as in the case of Example 1, using single-crystal Cr powder containing 0.1% Al and 0.2% Si, and these were then evaluated (Examples 8, 9).

TABLE 4

| | Blending ratio (volume 5) | | Cr | Trace elements present | Occurrence of | |
|---|---|---|---|---|---|---|
| | Single-crystal Cr | Cu | particle size (μm) | in Cr Element (weight %) | restriking Probability (%) | Notes |
| Example 8 | 30 | 70 | 100 | 0.1% Al | 0.15 | |
| Example 9 | 30 | 70 | 100 | 0.25% Si | 0.15 | |

Since the strength of the single crystals is increased by addition of trace Al and/or Si etc. in the range in which these can dissolve in solid solution in the Cr, the probability of cracking of the Cr particles due to forming, although it still exists, tends to be reduced, decreasing the frequency of restriking. This effect is not confined to Al or Si and it can easily be inferred that a like effect is obtained with other elements such as Ti and/or V.

COMPARATIVE EXAMPLE 5, EXAMPLES 10, 11

Next, other anti-arc constituents were studied.

Polycrystalline W powder of mean particle size 20 μm, single-crystal W powder of mean particle size 5 μm, and single-crystal W powder of mean particle size 9 μm containing 0.5% Re were prepared. Further, blending was effected using Cu powder of mean particle size 10 μm such that the contents of the respective W powders were the same as the content of the Cu powder. These powders were then mixed, respectively, and formed using a 5 Ton/cm$^2$ forming pressure.

Next, sintering was carried out under the conditions 1050° C.×2 Hr (hours) in a hydrogen vacuum atmosphere. Contacts were then obtained by forming with a forming pressure of 7 Ton/cm$^2$, followed by sintering under the conditions: 1050° C.×2 Hr (hours) under a hydrogen vacuum atmosphere. As described above, these were then processed to the prescribed shape, assembled in a vacuum valve, and the restriking performance evaluated (comparative Example 5, Examples 10 and 11 respectively).

TABLE 5

| | Anti-arc constituent | Blending ratio (volume %) W | Blending ratio (volume %) Cu | W particle size (μm) | Trace elements in the W Element (weight %) | Occurrence of restriking Probability (%) |
|---|---|---|---|---|---|---|
| Comparative Example 5 | Polycrystalline W | 50 | 50 | 20 | None | 0.75 |
| Example 10 | Single-crystal W | 50 | 50 | 5 | None | 0.35 |
| Example 11 | Single-crystal W | 50 | 50 | 9 | 0.5% Re | 0.25 |

In the same way as when Cr powder was employed, the restriking performance is improved by using single-crystal instead of polycrystalline W, and performance is further improved by addition of a trace content of a third element.

COMPARATIVE EXAMPLE 6, EXAMPLES 12, 13

Polycrystalline Mo powder of mean particle size 30 μm, single-crystal Mo powder of mean particle size 10 μm, and single-crystal Mo powder of mean particle size 10 μm containing 1% W were prepared. In addition, blending was effected using Cu powder of mean particle size 10 μm, such that the respective Mo powder contents became equal to the Cu powder content. These powders were respectively mixed and formed under a forming pressure of 5 Ton/cm$^2$.

Next, sintering was performed under the conditions 1050° C.×2 Hr (hours) under a hydrogen vacuum atmosphere. Contacts were obtained by further forming with a forming pressure of 7 Ton/cm$^2$, followed by sintering under the conditions: 1050° C.×2 Hr under a hydrogen vacuum atmosphere. These were then processed to the prescribed shape as described above, assembled into a vacuum valve, and the restriking performance evaluated (Comparative Example 6, Examples 12 and 13, respectively).

TABLE 6

| | Anti-arc constituent | Blending ratio (volume %) Mo | Blending ratio (volume %) Cu | Mo particle size (μm) | Trace element in the Mo Element (weight %) | Occurrence of restriking Probability (%) |
|---|---|---|---|---|---|---|
| Comparative Example 6 | Polycrystalline Mo | 50 | 50 | 30 | None | 0.80 |
| Example 12 | Single-crystal Mo | 50 | 50 | 10 | None | 0.45 |
| Example 13 | Single-crystal Mo | 50 | 50 | 10 | 1% W | 0.40 |

As in the case of use of Cr and W powder, the restriking performance was improved by the change from polycrystalline to single-crystal Mo, and further improvement in performance was obtained by addition of a trace amount of a third element. As can be seen from these embodiments, the restriking performance is improved by using single-crystal powder for the anti-arc component powder, and further improvement in performance is obtained by addition of a trace amount of a third element. It was found that the same effect was obtained not only with elements of the Cr, W, Mo—Cu system, but also with other composition systems such as the Ti—Ag system.

Furthermore, when minute amounts of up to 1 volume % of the welding-preventing constituents Bi, Te or Sb etc. were added to these composition systems, and evaluation conducted in the same way as above, it was found that these acted in the beneficial direction, greatly reducing the load on the switch mechanism and reducing the probability of restriking.

As described above, it was found that, by making the anti-arc constituent powder a single-crystal powder and furthermore by adding a trace amount of a third element to the anti-arc constituent, even though the solid-phase sintering method was employed, the voltage withstanding characteristic (in particular occurrence of restriking) can be improved.

By the use of the present invention, contacts of excellent voltage-withstanding performance can be provided by a low-cost solid-phase sintering method. It should be noted that, clearly, the method of assembly of the anti-arc constituents is not restricted to that described in the Examples.

As described above, with the present invention, a vacuum valve contact material can be provided with an improved and stable voltage-withstanding performance (in particular, reduced occurrence of restriking).

Obviously, numerous additional modifications and variations of the present invention are possible in light of the above teachings. It is therefore to be understood that within the scope of the appended claims, the invention may be practiced otherwise than as specially described herein.

What is claimed as new and desired to be secured by Letters Patent of the United States is:

1. Vacuum valve contact material manufactured by a process comprising:

mixing an anti-arc constituent powder and a conductive constituent powder to form a mixed powder;

forming said mixed powder to constitute a formed body; and sintering said formed body below a melting point of said conductive constituent powder, wherein said vacuum valve contact material includes conductive constituent grains and anti-arc constituent grains;

the anti-arc constituent grains comprise at least one of Cr, W, Mo and Ti; and not less than 50 volume % of said anti-arc constituent powder is a single-crystal anti-arc constituent powder.

2. The vacuum valve contact material according to claim 1, wherein said conductive constituent powder comprises at least one of Cu and Ag.

3. The vacuum valve contact material according to claim 1, wherein said anti-arc constituent powder forms 20 to 60 volume % of said vacuum valve contact material.

4. The vacuum valve contact material according to claim 1, wherein a mean particle size of said anti-arc constituent grains is not more than 150 $\mu$m.

5. The vacuum valve contact material according to claim 1, wherein said anti-arc constituent grains comprise Cr and further comprise at least one element selected from Al, Si, Ti, V, Zr, Mo, W and Fe in an amount of not more than 1 weight %.

6. The vacuum valve contact material according to claim 1, wherein said anti-arc constituent grains comprise W and further comprise at least one metal selected from Mo, Re, Ta and Nb in an amount of not more than 1 weight %.

7. The vacuum valve contact material according to claim 1, wherein said anti-arc constituent grains comprise Mo and further comprise at least one metal selected from W, Re, Ta and Nb in an amount of not more than 1 weight %.

8. The vacuum valve contact material according to claim 1, further comprising not more than 1 volume % of at least one element selected from Bi, Te and Sb.

9. A vacuum valve contact material including conductive constituent grains and anti-arc constituent grains, wherein the anti-arc constituent grains comprise at least one of Cr, W, Mo and Ti; and not less than 50 volume % of said anti-arc constituent grain is a single-crystal anti-arc constituent powder.

10. The vacuum valve contact material according to claim 9, wherein said conductive constituent grains comprise at least one of Cu and Ag.

11. The vacuum valve contact material according to claim 9, wherein said anti-arc constituent grains form 20 to 60 volume % of said vacuum valve contact material.

12. The vacuum valve contact material according to claim 9, wherein a mean particle size of said anti-arc constituent grains is not more than 150 $\mu$m.

13. The vacuum valve contact material according to claim 9, wherein said anti-arc constituent grains comprise Cr and further comprises at least one element selected from Al, Si, Ti, V, Zr, Mo, W and Fe in an amount of not more than 1 weight %.

14. The vacuum valve contact material according to claim 9, wherein said anti-arc constituent grains comprise W and further comprise at least one metal selected from Mo, Re, Ta and Nb in an amount of not more than 1 weight %.

15. The vacuum valve contact material according to claim 9, wherein said anti-arc constituent grains comprise Mo and further comprise at least one metal selected from W, Re, Ta and Nb in an amount of not more than 1 weight %.

16. The vacuum valve contact material according to claim 9, further comprising not more than 1 volume % of at least one element selected from Bi, Te and Sb.

17. A method of manufacturing a vacuum valve contact material, the method comprising mixing an anti-arc constituent powder and a conductive constituent powder to form a mixed powder, wherein not less than 50 volume % of said anti-arc constituent powder is a single-crystal anti-arc constituent powder;

forming said mixed powder to constitute a formed body;

sintering said formed body below a melting point of said conductive constituent powder; and forming the vacuum valve contact material of claim 9.

18. A method of using a vacuum valve contact material, the method comprising using the vacuum valve contact material of claim 9 in a vacuum valve.

* * * * *